US006227454B1

(12) United States Patent
Wolf et al.

(10) Patent No.: US 6,227,454 B1
(45) Date of Patent: May 8, 2001

(54) DEVICE AND METHOD FOR APPLYING NIGHT-VISIBLE ROAD MARKINGS

(75) Inventors: Charles R. Wolf; Howard Schierling, both of Salem, OR (US)

(73) Assignee: Jackson Products, Inc., Chesterfield, MO (US)

( * ) Notice: Subject to any disclaimer, the term of this patent is extended or adjusted under 35 U.S.C. 154(b) by 0 days.

(21) Appl. No.: 09/353,698

(22) Filed: Jul. 14, 1999

(51) Int. Cl.[7] ..... B05B 17/00

(52) U.S. Cl. ..... 239/1; 239/455; 239/456; 239/505; 239/668; 239/673; 239/676

(58) Field of Search ..... 404/93, 94, 75; 239/443, 444, 451, 455, 456, 504, 505, 506, 668, 670, 673, 676, 416.2; 222/502, 503

(56) References Cited

U.S. PATENT DOCUMENTS

| | | | | |
|---|---|---|---|---|
| 3,477,352 | | 11/1969 | Harding et al. | 404/93 |
| 4,236,950 | * | 12/1980 | Eigenmann | 404/93 |
| 4,802,788 | | 2/1989 | Smith | 404/93 |
| 5,114,268 | | 5/1992 | Marcato | 404/93 |
| 5,439,312 | | 8/1995 | Marcato | 404/93 |
| 5,511,896 | | 4/1996 | Marcato | 404/93 |
| 5,642,962 | | 7/1997 | Marcato | 404/93 |
| 5,853,263 | * | 12/1998 | Green | 404/93 |
| 5,934,822 | * | 8/1999 | Green | 404/94 |
| 5,975,795 | * | 11/1999 | Green | 404/93 |

* cited by examiner

*Primary Examiner*—David A. Scherbel
(74) *Attorney, Agent, or Firm*—Dunlap, Codding & Rogers, P.C.

(57) ABSTRACT

A device for applying night-visible road markings includes a material hopper, a floor gate, a pair of side runners and a plurality of vertically oriented shutters. When the floor gate is moved away from an outlet extending through a bottom side of the hopper, marking material flows from the hopper, through the outlet and onto the surface of a road. The vertically oriented shutters are positioned between the side runners, which serve as side forms for marking material dispensed onto the road surface, and rearwardly of the hopper outlet. The distance between the bottom edges of the shutters and the road surface determines the amount of marking material that passes thereunder, thereby determining the thickness of the road marking. By positioning the shutters at different relative elevations, road markings of various patterns including markings having varying thicknesses across their width can be produced for increased reflectivity of the road markings.

23 Claims, 4 Drawing Sheets

DEVICE AND METHOD FOR APPLYING NIGHT-VISIBLE ROAD MARKINGS

BACKGROUND OF THE INVENTION

1. Field of the Invention

The present invention relates to devices and methods for marking road surfaces and, more particularly, to devices and methods for creating road markings of various patterns including markings having varying thicknesses across their widths for increased reflectivity.

2. Description of the Related Art

The surfaces of roads, highways, parking lots and the like (hereinafter "road surfaces") are commonly marked with lines, stripes and other indicators (hereinafter "road markings") for designating traffic and parking lanes, and for similar purposes. To improve the visibility of such road marking s during low-light and nighttime conditions, the markings are commonly formed using reflective materials, including small glass beads that are frequently deposited over the road markings shortly after the markings are applied to a road surface (and before the markings dry or cure)

To further increase the reflectance of road markings, it is known to form multiple steps or tiers in the markings, where adjacent tiers are connected by an inclined or sloping section. These tiered and sloping sections, referred to in the trade as "profiles," constitute retroreflective surfaces that generally reflect light into the line of sight of oncoming traffic. Road markings of this type are commonly formed using a road marking device comprising a material hopper, a floor gate, a pair of side runners and a vertically oriented shutter. In use, the side runners are dragged along, and support the hopper above, the road surface. The floor gate is positioned adjacent to an outlet extending through a bottom side of the hopper and, in its closed position, covers the outlet and prevents marking material from flowing therethrough. When the floor gate is moved away from the outlet, marking material flows through the outlet and onto the road surface between the pair of side runners. The runners thus serve both to provide sliding support for the device as well as to provide side forms which limit lateral flow of the marking material and thereby define the side edges of the road marking. The tiers are formed in the road marking (i.e., the thickness of the road marking is intermittently varied along its length) by adjusting the height of the vertically oriented shutter, which is positioned between the side runners of the device and rearwardly of the hopper outlet. If the shutter is arranged, for example, such that its bottom edge is spaced an eighth of an inch from the road surface, the shutter will permit only one-eighth of an inch of marking material to pass thereunder, thus yielding a road marking having, at that location, a uniform thickness of approximately one-eighth of an inch. Changing the elevation of the shutter as the device is advanced along the road surface results in the inclined or sloped sections mentioned above.

Although suited for its intended purpose, the device described immediately above can produce road markings having only limited profile patterns (i.e., the aforementioned multi-tiered patterns), where the thickness of the road marking at any given point is generally constant across its width.

There is also known a method for applying a road marking where the thickness of the marking is varied across its width to increase the reflectivity of the road marking while preventing water from accumulating along the edges thereof during wet conditions. However, the numerous steps associated with this method render it difficult and expensive to implement. These steps include applying a traffic stripe to a road surface, applying a reflective material to the traffic stripe, applying an anti-adhesion agent to prevent adhesion between the applied traffic stripe and a deformation means passing over it, and then deforming the traffic stripe using a rotatable wheel having a plurality of projections or teeth around the periphery thereof to form spaced grooves in the traffic stripe. This method is also disadvantaged in that the grooves formed in the road stripe are a function of the tooth pattern on the rotatable wheel. Thus, when it is desired to change the pattern of the grooves formed in the road stripe, the tooth pattern on the rotatable wheel must somehow be changed, or a different rotatable wheel must be employed.

What is needed is a device and method for producing night-visible road markings having profile patterns in addition to the multi-tiered patterns discussed above, where the additional profile patterns would increase the reflectivity of the road marking during low-light and night time conditions. Preferably, such patterns could be formed in a single pass of the device over the road surface, and the profile patterns could preferably be varied "on the fly" without requiring equipment changes.

SUMMARY OF THE INVENTION

In order to solve these and other needs in the prior art, the inventors hereof have succeeded at designing and developing a device and method for applying marking material to a road surface, where the thickness of the marking material can be varied not only along its length, but across its width as well. Significantly, such markings can be formed in a single pass of the device, and the particular profile pattern of the marking can be varied as desired "on the fly" without requiring equipment changes. Moreover, a virtually limitless number of profile patterns can be implemented using the teachings of the present invention.

In accordance with one aspect of the present invention, a road marking device comprises a hopper for holding marking material, where the hopper includes an outlet for dispensing the marking material onto a road surface, and a plurality of shutters for controlling the thickness of marking material dispensed onto the road surface by the device. The shutters are preferably positioned on a rear side of the device for reciprocal movement in a generally vertical direction, and are preferably positioned adjacent to one another and configured for selective movement into different relative positions for creating a road marking having a varying thickness across its width. The device may also comprise a gate positioned on a bottom side thereof for reciprocal movement in a generally horizontal direction, and the shutters are preferably substantially aligned with the gate so as to traverse the same portion of road surface as the gate when the device is moved along the road surface. Preferably, the gate and shutters are selectively movable into sealing engagement with one another for covering the hopper outlet. The preferred number of shutters is two, although a greater number of shutters can easily be employed, if desired.

In accordance with another aspect of the present invention, in a road marking device having a bottom opening and a bottom gate selectively movable with respect to the bottom opening between open and closed positions, where the device is configured to dispense marking material through the bottom opening and onto a road surface when the bottom gate is in the open position, the improvement comprises at least two shutters substantially aligned with the bottom opening for controlling the thickness of any marking material dispensed therethrough. The shutters are preferably positioned immediately adjacent one another and rearwardly with respect to the bottom gate, and the bottom gate is preferably arranged for reciprocal movement in a generally horizontal direction, while the shutters are arranged for reciprocal movement in a generally vertical direction. The width of each shutter is preferably one-half the width of the bottom gate.

In accordance with yet another aspect of the present invention, a method of marking a road surface comprises the step of applying onto the road surface a layer of marking material having a varying thickness across its width. This applying step preferably includes the steps of applying a first stripe of marking material onto the road surface, and applying a second stripe of marking material onto the road surface adjacent to the first stripe, where the thicknesses of the first and second stripes are different. The steps of applying the first and second stripes are preferably performed simultaneously, and the thickness of at least the first stripe is preferably varied intermittently as it is applied to the road surface.

In accordance with still another aspect of the present invention, a method of using a road marking device having at least two shutters comprises the step of dispensing marking material from the device while the shutters are at different elevations to thereby yield a road marking having a varying thickness across its width. The elevations of the shutters are preferably varied as the road marking device is advanced along the road surface to thereby vary the thickness of the road marking along its length. Marking material may also be dispensed from the device while the shutters are at the same elevation to thereby yield a road marking having a generally uniform thickness across its width.

While the principal advantages and features of the present invention have been described above, a greater and more thorough understanding of the invention can be attained by referring to the drawings and the detailed description of the preferred embodiments which follow.

DETAILED DESCRIPTION OF THE PREFERRED EMBODIMENTS

Figure 1:
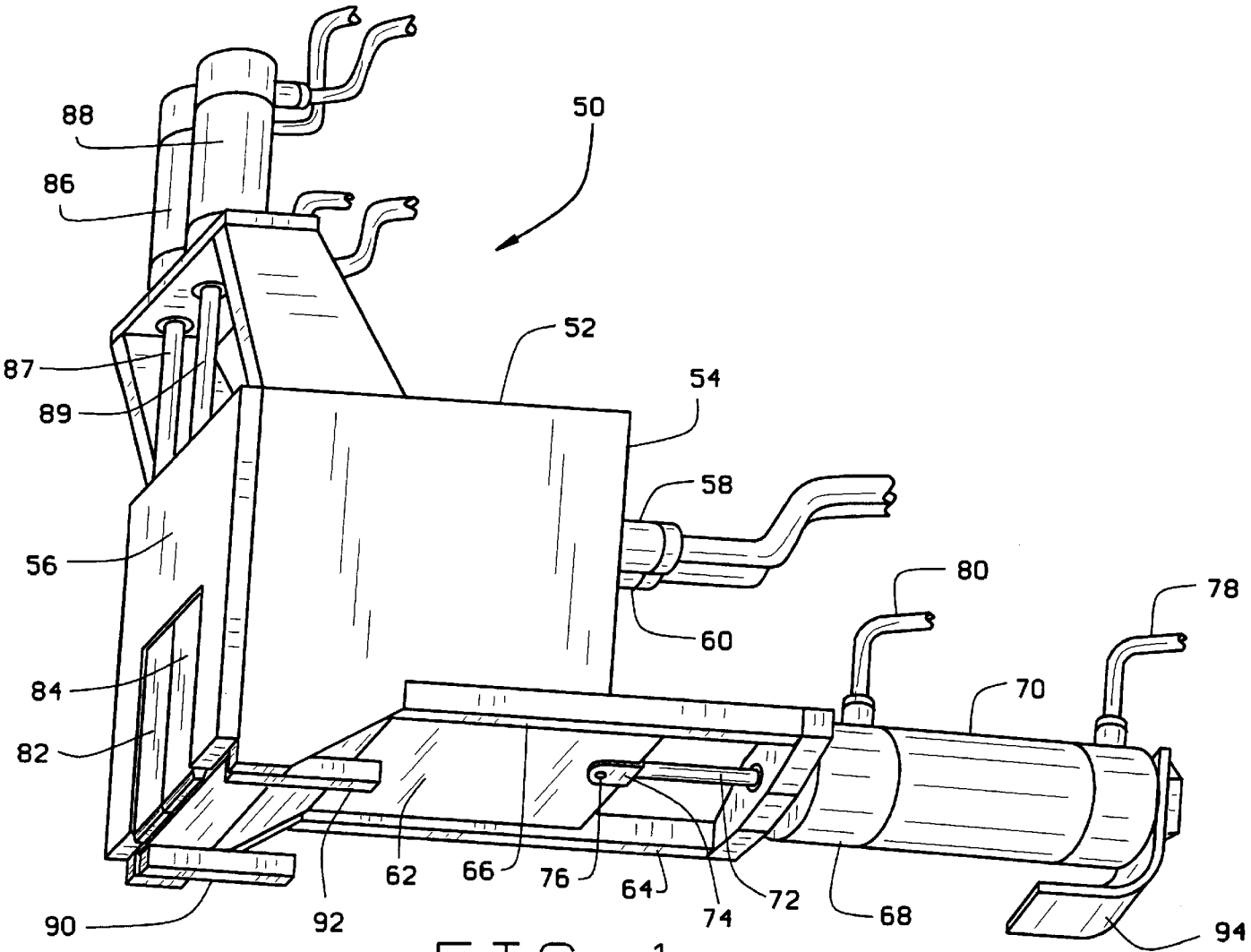
FIG. 1 is a perspective view of a road marking device according to one aspect of the present invention.
Figure 2:
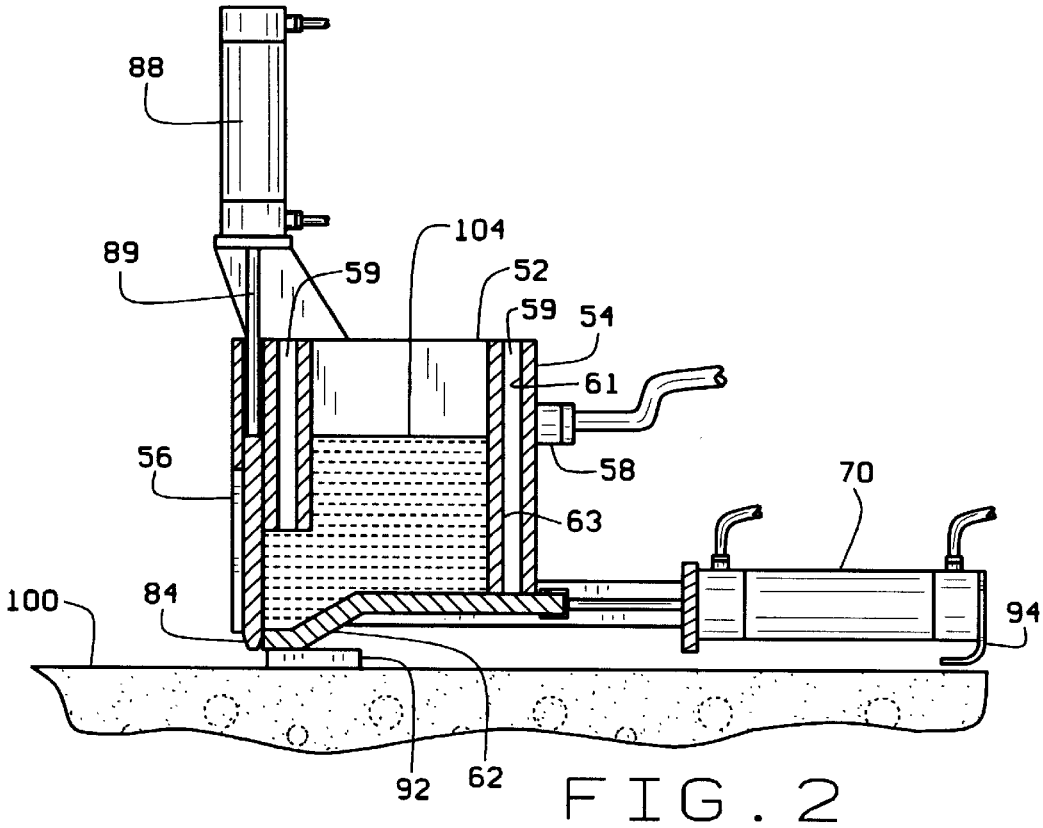
FIG. 2 is a sectional view of the road marking device shown in FIG. 1 illustrating the floor gate in its closed position.

A preferred road marking device according to the present invention is shown in FIG. 1 and is designated generally by reference character 50. As shown in the figures, the device 50 includes a hopper 52 having a front side 54 and a rear side 56. Mounted to the hopper front side 54 are a pair of conduit fittings 58, 60 which are coupled to opposite ends of a conduit 59 extending through the tubular walls 61, 63 of the hopper 52, as shown in FIG. 2. Positioned on the bottom side of the hopper 52 is a floor gate 62 which is slidably mounted in guides 64, 66 on opposite sides thereof for selective reciprocal movement in a generally horizontal direction. As shown in FIG. 1, the floor gate 62 is coupled to an air cylinder assembly 68 (including an air cylinder 70 and cylinder rod 72) by way of a clevis 74 and pin 76. The air cylinder 70 includes a pressure line 78 for causing movement of the cylinder rod 72 in a first direction, and a pressure line 80 for causing movement of the cylinder rod 72 in an opposite direction. With reference to FIG. 1, movement of the cylinder rod 72 in either the left or right direction results in corresponding movement of the floor gate 62.

Mounted on the rear side 56 of the hopper 52 are two shutters 82, 84, which are coupled to cylinder rods 87, 89 of air cylinder assemblies 86, 88, respectively. The shutters 82, 84 are each mounted for selective reciprocal movement in a generally vertical direction. Thus, movement of the cylinder rods 87, 89 in the up or down direction causes corresponding movement of the shutters 82, 84, respectively. Each of the air cylinder assemblies 68, 86, 88 are coupled to one or more unshown sources of pressurized air. As will be apparent, the shutters 82, 84 function to control the thickness of any road marking material passing thereunder, and to control the extent to which a hopper outlet 96 is exposed, thereby controlling the amount of marking material dispensed from the hopper.

A pair of side runners 90, 92 are provided for supporting the hopper 52 above a road surface, while an additional runner 94 is provided for maintaining positive clearance between the air cylinder 70 and the road surface when the device 50 is not attached to mobile equipment. (Note that when the device 50 is attached to the mobile equipment, the front end of the device (including the air cylinder 70 and the runner 94) is suspended above the road surface such that only the runners 90, 92 contact the road). In the closed position shown in FIG. 2, the floor gate 62 makes sealing contact with the backsides of the shutters 82, 84 to cover an outlet 96 in the hopper (shown in FIG. 3) and prevent marking material 104 contained within the hopper 52 from flowing through the outlet 96.

Figure 4A:
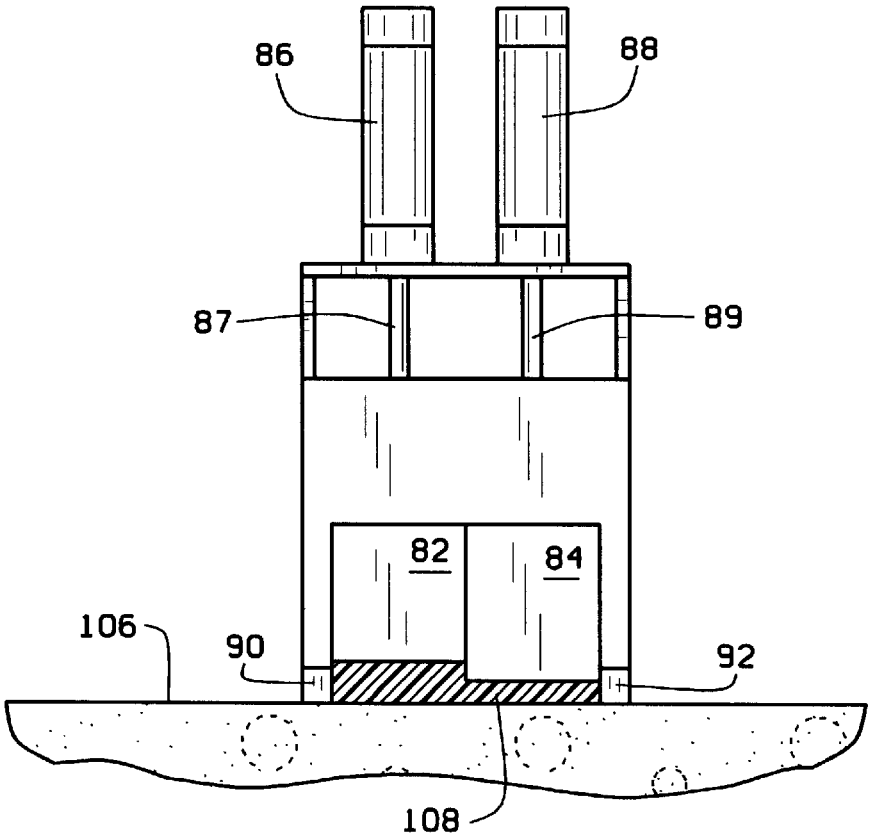
FIGS. 4(*a*) and 4(*b*) are rear and top views, respectively, illustrating the application of a profiled road marking having a varying thickness across its width.
Figure 4B:
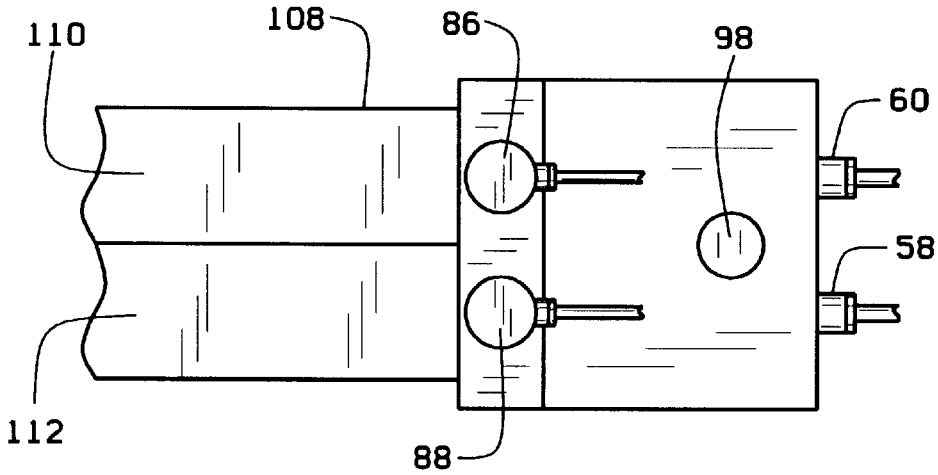

The device 50 shown in FIG. 1 is specifically designed for attachment to existing mobile equipment that is configured for dragging the device 50 along a road surface, supplying pressurized air under control to the air cylinder assemblies 68, 86, 88, supplying marking material under pressure to the hopper 52 via an inlet 98 (shown in FIG. 4(*b*)) on a top side of the hopper, and supplying hot oil to the conduit fittings 58, 60 for circulating the oil through the tubular walls of the hopper to thereby heat or maintain the temperature of any marking material contained by the hopper. For purposes of the present invention, the existing mobile equipment merely needs to be modified for supplying pressurized air under control to each of the air cylinder assemblies 68, 86, 88.

The device 50 is preferably constructed from steel components, and the runners 90, 92 are preferably constructed from hardened steel, and preferably comprise carbide on their bottom surfaces. The air cylinder assembly 68 is preferably a Bimba model 311-DXP #TJ, and the air cylinder assemblies 86, 88 are both preferably a Bimba model 241 5-DP MK.

Figure 3:
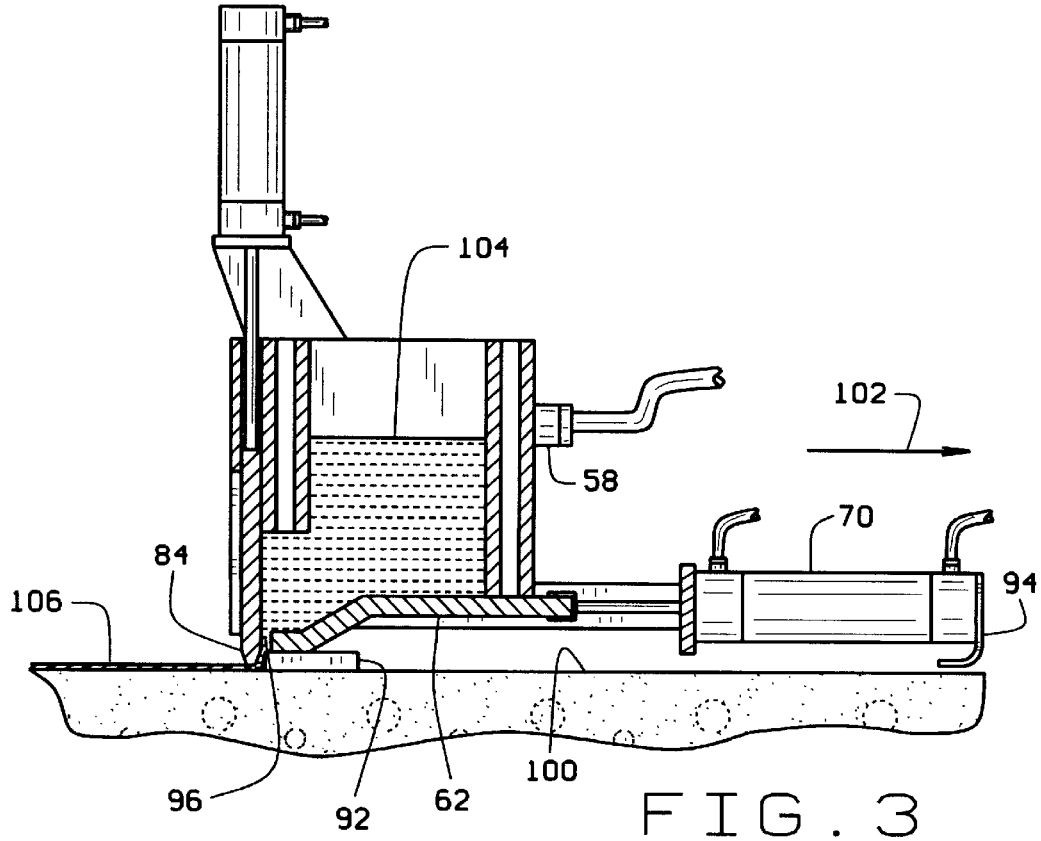
FIG. 3 is a sectional view of the device shown in FIG. 1 illustrating the application of a road marking when the floor gate is in an open position.

In use, the device 50 is set upon a road surface 100 to be marked, such as a concrete or asphalt road, and is coupled to mobile equipment (not shown) for advancing the device 50 along the road surface in the direction shown by the arrow 102 in FIG. 3. To commence marking, the air cylinder 70 is actuated to move the floor gate 62 into the open position shown in FIG. 3, thereby exposing the hopper outlet 96, whereupon marking material 104 exits through that portion of the outlet 96 that is exposed between the floor gate 62 and the bottom edges of the shutters 82, 84. As shown in FIG. 3, the shutters 82, 84 limit the amount of marking material that can pass thereunder, thereby controlling the thickness of the road marking 106 formed by the device 50.

In FIG. 3, the shutters 82, 84 are both positioned at the same elevation such that the road marking 106 has a generally constant thickness across its width (i.e., in the direction extending into the page, in FIG. 3). In other words, the shutters 82, 84 can be moved in tandem, where desired, to essentially function as a single shutter. As noted above, the side runners 90, 92 constitute side forms which limit lateral flow of the marking material 104 and thereby define the side edges of the road marking 106. In the most preferred embodiment, the side runners 90, 92 are spaced approximately four inches apart for producing road markings having a four inch width, although other widths can obviously be implemented, where desirable.

As shown in FIGS. 4(*a*) and 4(*b*), the shutters 82, 84 can also be adjusted to different relative elevations to thereby yield a road marking 108 having a varying thickness across its width. In this preferred embodiment, the shutters are each approximately two inches wide (i.e., one-half the width of the floor gate 62 and the hopper outlet 96), such that road marking 108 includes first and second portions 110, 112, each of which is two inches wide, having different thicknesses. Of course, the thickness of both portions 110, 112 can be set to any desired value, and is limited only by the maximum available travel of the air cylinder rods 87, 89 which, in this embodiment, is approximately 0.650 inches. Moreover, at any given time, either or both shutters can be moved into contact with the road surface 106 to prevent marking material from passing thereunder, thereby forming a break in one or both of the corresponding portions 110, 112 (assuming road surface 106 is smooth). However, in the inventors' most preferred embodiment, the "resting position" of the shutters (i.e., the lowest position of the shutters with respect to the road surface) is set so that the tips of the shutters remain spaced from the road surface by approximately 0.060 to 0.150 inches. With the floor gate open and the shutters in this resting position, the device 50 can apply a "baseline" of marking material having a uniform thickness along its length, as shown in FIG. 3. Also in this embodiment, the device is preferably configured so that the shutters are movable either in tandem or in opposite directions relative to one another.

Figure 5A:
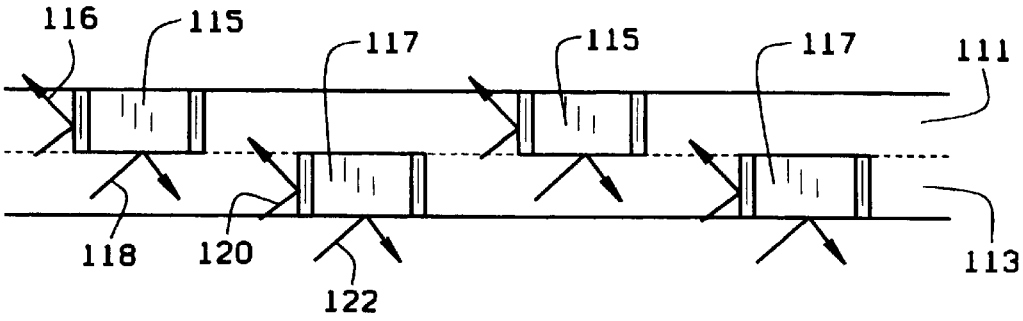
FIGS. 5(*a*) and 5(*b*) are top and side views, respectively, of an exemplary road marking pattern according to the present invention.
Figure 5B:
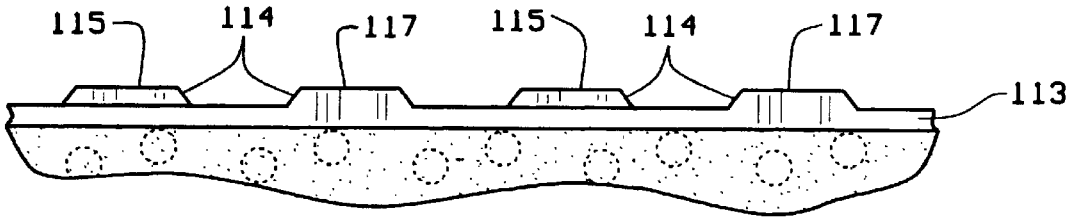
Figure 6A:
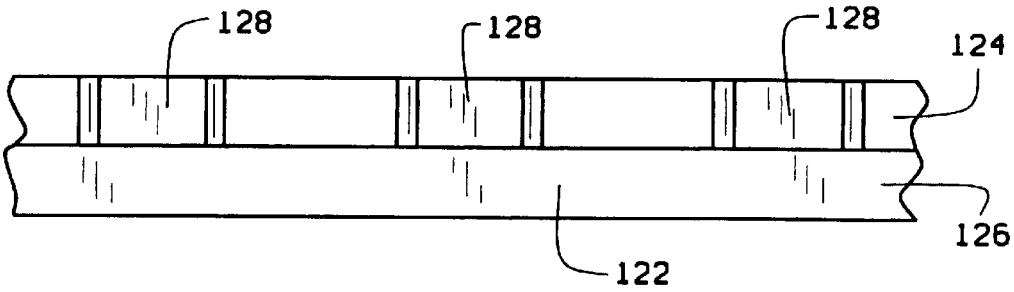
FIGS. 6(*a*) and 6(*b*) are top and side views, respectively, of another exemplary road marking pattern according to the present invention.
Figure 6B:
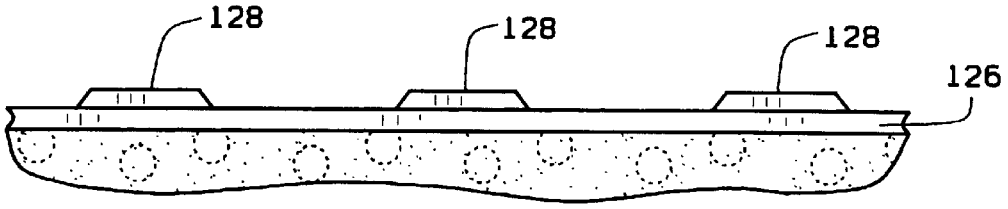

FIGS. 5 and 6 illustrate a couple of the various road marking patterns which can be produced by the preferred device 50. Specifically, FIGS. 5(*a*) and 5(*b*) illustrate a staggered profile marking, which essentially consists of two adjacent baselines 111, 113 having intermittently formed profiles 115, 117 arranged side-by-side in an alternating fashion. FIG. 5(*b*) is a side view of the road marking shown in FIG. 5(*a*), and illustrates the sloping surfaces 114 that are formed in the road marking as a result of adjusting the elevation of the shutters 82, 84 as the device 50 is advanced along the road surface. Where sloping surfaces are not desired, well-defined steps may be formed by configuring the device 50 to adjust the elevations of the shutters more rapidly, or by stopping the device before the shutter positions are adjusted. FIG. 5(*a*) also includes a number of arrows 116, 118, 120, 122 to illustrate the pattern of light reflections that may be generated by the road marking in response to a vehicle's headlights. Note that the series of light reflections in various directions, as indicated by arrows 116, 118, 120, 122, are especially useful for attracting the attention of drivers, and thus for designating the perimeter of a traffic lane, for example, during low-light or nighttime conditions.

FIG. 6(*a*) illustrates another possible road marking made possible by the present invention, which essentially consists of two adjacent baselines 124, 126, only one of which (i.e., baseline 124) has profiles 128 intermittently formed thereon. Such a road marking may be particularly suited for delineating a traffic lane along, for example, a curved portion of a roadway. Indeed, a much larger number of profile patterns can be produced according to the present invention, and may be varied as required for a particular portion of a roadway. In other words, the pattern most suitable for any particular portion of a roadway may depend upon whether that portion is in a "peak" or "valley," or along the inside or outside of a curve. The profile patterns may also be varied as necessary to accommodate proper water drainage during wet conditions and/or to ensure one or more portions of a particular road marking protrude above water on a wet road surface. Further, the patterns can be tailored to generate vibrations in a vehicle when the vehicle veers onto the road marking for the purpose of alerting drivers, including sleepy or fatigued drivers, that their vehicle is leaving its designated traffic lane. As should be apparent, it is also possible to continuously vary the thicknesses of the road markings along their lengths and across their widths, where desirable. In addition, by modifying the device 50 so as include more than two shutters, a virtually limitless number of patterns can be produced, where the thickness of a road marking can be varied continuously across its width.

There are various changes and modifications which may be made to the preferred embodiment disclosed herein, as apparent to those skilled in the art upon reading this disclosure. For example, the side runners 90, 92 of the device 50 can be spaced as to provide road markings having widths greater or less than four inches, or the widths of the shutters 82, 84 can be changed so they are different relative to one another. The benefits disclosed herein may also be achieved with a device having shutters that are not vertically oriented, or where the floor gate moves in other than a generally horizontal direction, or where the hopper outlet is not positioned on the bottommost surface of the hopper. It is also possible to configure the device so that the shutters are not immediately adjacent one another. It should be clear, however, that these and other variations are suggested by the teachings of the present invention, and the invention should therefore be limited only by the scope of the following claims, and their equivalents.

What is claimed is:

1. A road marking device comprising a hopper for holding marking material, said hopper including an outlet for dispensing said marking material onto a road surface, and a plurality of shutters adjacent the outlet for controlling the thickness of marking material dispensed onto said road surface by said device, said shutters are positioned adjacent to one another and to the outlet and are configured for selective movement into different positions relative to each other and the outlet for dispensing marking material from the outlet and creating a road marking having a varying thickness across its width.

2. The device of claim 1 wherein said shutters are positioned on a rear side of said device for reciprocal movement in a generally vertical direction.

3. The device of claim 1 further comprising a gate positioned on a bottom side of said device for reciprocal movement in a generally horizontal direction.

4. The device of claim 3 wherein said shutters are substantially aligned with said gate so as to traverse the same portion of road surface as said gate when said device is moved along the road surface.

5. The device of claims 4 wherein said gate and said shutters are selectively movable into sealing engagement with one another for covering said outlet.

6. The device of claim 3 wherein said plurality is two.

7. The device of claim 6 further comprising a pair of runners for supporting said hopper above the road surface, said gate being positioned between said runners.

8. The device of claim 3 further comprising a separate air cylinder assembly for each shutter and gate.

9. The device of claim 1 wherein said device is configured to move said shutters in tandem.

10. The device of claim 1 wherein said device is configured to move said shutters in opposite directions relative to one another.

11. The device of claim 1 wherein said device is configured to move said shutters into a resting position spaced approximately 0.060 to 0.150 inches above the road surface.

12. The device of claim 1 wherein the plurality of shutters are positioned side by side.

13. In a road marking device having a bottom opening and a bottom gate selectively movable with respect to said bottom opening between open and closed positions, the device being configured to dispense marking material through the bottom opening and onto a road surface when the bottom gate is in the open position, the improvement comprising at least two shutters substantially aligned with said bottom opening for controlling the thickness of any marking material dispensed therethrough, the at least two shutters being independently moveable relative to each other to dispense two separate thicknesses of the marking material from the bottom opening.

14. The device of claim 13 wherein said shutters are positioned immediately adjacent one another and rearwardly with respect to said bottom gate.

15. The device of claim 13 wherein said bottom gate is arranged for reciprocal movement in a generally horizontal direction, and said shutters are arranged for reciprocal movement in a generally vertical direction.

16. The device of claim 13 wherein each shutter has a width approximately one-half the width of said bottom gate.

17. A method of marking a road surface, the method comprising the steps of applying onto said road surface a layer of marking material having a lateral width and varying the thickness of the applied material across its width.

18. The method of claim 17 wherein the applying step includes the steps of applying a first stripe of marking material onto the road surface, and applying a second stripe of marking material onto the road surface adjacent to said first stripe, wherein the thicknesses of said first and second stripe are different.

19. The method of claim 18 wherein the steps of applying the first and second stripe are performed simultaneously.

20. The method of claim 19 further comprising the step of intermittently varying the thickness of at least said first stripe as it is applied to said road surface.

21. A method of using a road marking device having at least two shutters that have independently adjustable elevations, the method comprising the steps of dispensing marking material from said device and adjusting the elevations of the at least two shutters to thereby yield a road marking having a varying thickness across its width.

22. The method of claim 21 further comprising the step of varying the elevations of said shutters to thereby vary the thickness of said road marking along its length.

23. The method of claim 21 further comprising the step of dispensing marking material from said device while said shutters are at the same elevation to thereby yield a road marking having a generally uniform thickness across its width.

* * * * *